US008297295B2

(12) United States Patent
Banerjee

(10) Patent No.: US 8,297,295 B2
(45) Date of Patent: Oct. 30, 2012

(54) MULTI-FOLD UMBRELLA COMBINED WITH WRITING IMPLEMENT OR COSMETIC CASE

(76) Inventor: Ashoke Banerjee, Dartmouth, MA (US)

( * ) Notice: Subject to any disclaimer, the term of this patent is extended or adjusted under 35 U.S.C. 154(b) by 0 days.

(21) Appl. No.: 12/983,307

(22) Filed: Jan. 1, 2011

(65) Prior Publication Data

US 2012/0167932 A1 Jul. 5, 2012

(51) Int. Cl.
*A45B 19/00* (2006.01)

(52) U.S. Cl. ..... 135/16; 135/25.41; 135/34.2

(58) Field of Classification Search ..... 135/16, 135/25.41, 34.2, 24
See application file for complete search history.

(56) References Cited

U.S. PATENT DOCUMENTS

| | | | | | |
|---|---|---|---|---|---|
| 1,762,869 | A * | 6/1930 | Kratochwill | 135/66 |
| 2,091,676 | A * | 8/1937 | Fliegner | 135/25.31 |
| 2,266,684 | A * | 12/1941 | Brown | 135/16 |
| 3,245,421 | A * | 4/1966 | Braun et al. | 135/16 |
| 3,538,928 | A * | 11/1970 | Bela et al. | 135/20.2 |
| 3,651,822 | A * | 3/1972 | Yasuda et al. | 135/24 |
| 3,954,117 | A * | 5/1976 | Wallace | 135/20.2 |
| 4,842,003 | A * | 6/1989 | Baldwin et al. | 135/19.5 |
| 4,962,779 | A * | 10/1990 | Meng | 135/16 |
| 5,388,603 | A * | 2/1995 | Bauer et al. | 135/16 |
| 5,421,460 | A * | 6/1995 | Bosshard | 206/573 |
| 6,334,454 | B1 * | 1/2002 | Williams | 135/25.41 |
| 2008/0163915 | A1 * | 7/2008 | Wobrock | 135/118 |

* cited by examiner

*Primary Examiner* — Noah Chandler Hawk
(74) *Attorney, Agent, or Firm* — Cserr IP Strategies

(57) ABSTRACT

A thin plastic, fold-up umbrella with thin structural supports which fits within a writing implement case, a personal care product case or case for other products normally carried by a user. The case becomes the handle for the umbrella stored in the case with the personal use product to insure that the umbrella will always be carried by the person.

4 Claims, 4 Drawing Sheets

MULTI-FOLD UMBRELLA COMBINED WITH WRITING IMPLEMENT OR COSMETIC CASE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to umbrellas and particularly to an umbrella having a push button automatic extending telescopic post with fine multi-fold ribs for compact storage within the handle portion of a writing implement, or alternately the handle portion of a cosmetic case.

2. Description of Related Art Including Information Disclosed Under 37 CFR 1.97 and 1.98

According to the American Cancer Society and others, people engaging in outdoor activities during the summer months and, for that matter the entire year, are encouraged to cover as much as the unprotected portion of the exposed skin from direct contact with sunlight. One method of accomplishing this is to wear head covering and neck covering, the most vulnerable or exposed portion of the human anatomy, especially during participation of a spectator sport, are the head, face, and back of the neck, assuming normal attire is worn.

It is not always possible to have a hat therefore, people have resorted to using a handheld sun shield devices to accomplish this task. These, however can be bulky and difficult to carry.

Compact umbrellas having multi-folding ribs are well known. It would be advantageous to have an umbrella or sunshade that would be combined with an item that would already be carried by the user, such as a pen or a lipstick case or other cosmetic or personal care item carrying case. Such an item could be carried on a daily basis and would also provide protection from unexpected rain showers.

Prior art U.S. Pat. No. 1,807,686, issued Jun. 2, 1931 to Bright, provides a combined parasol, vanity case, and coin holder. The vanity case is a hollow compartment located on the opposite end of the staff from the handle, and is detachable from the staff. The vanity case is for holding lipstick, powder puff, or other articles of a similar nature that are usually found in a vanity case.

Prior art U.S. Pat. No. D176,909, issued Feb. 14, 1956 to Fellerman, shows the ornamental design for a combined umbrella and writing implement.

Prior art U.S. Pat. No. 6,789,555, issued Sep. 14, 2004 to Thomas, claims an umbrella and article holder that includes an umbrella having a shaft, a handle connected to one end of the shaft, and a fabric covering connected to an opposite end of the shaft and adapted to open up to provide a protective covering against rain, snow and sleet; at least one article holder connected with the handle of the umbrella for holding at least one article when the umbrella is held in an upright configuration; and a leg securing strap for securing the umbrella to a leg of a person such that the umbrella remains in the upright configuration whether the person is sitting or standing. The article holder may include a drink holder, cigarette box holder, cigarette lighter holder and pen holder connected to an upper end of the handle, and a hook for holding at least one of a hat and coat and an extension for holding a shopping bag connected to a lower end of the handle.

Prior art U.S. Pat. No. 5,821,756, issued Apr. 18, 1989 to England, shows a collapsible disposable umbrella formed from plastic, polyethylene and/or kraft paper components. The invention has a tubular container that serves as a handle when the umbrella is in use. The other components of the unit are stored within the container and when partially removed therefrom, an umbrella support structure expands and locks into position with a few simple movements.

Prior art U.S. Pat. No. 5,069,237, issued Dec. 3, 1991 to Flanagan, is for a disposable umbrella apparatus made of thermoplastic and inexpensive materials and having a central staff made of a length of plastic pipe. Three short plastic dowels are mounted perpendicular through the staff and a plastic cap mounts to the top of the pipe to act as a stop for a fixed upper collar supporting the fixed struts of the umbrella and as a latch for a slidable collar carrying the collapsing umbrella struts. The slidable collar has an opening therethrough and slides along the staff pipe and the latching for the umbrella uses a pair of grooves along the inside of the opening the slidable collar so that the collar can slide over one of the plastic dowels protruding from the staff and abut against a second dowel protruding from the staff and then rotated between the two dowels to latch the collars and struts in position to hold the umbrella in an open position. The collar is thus rotated to misalign the grooves with respect to the dowel on either side thereof to prevent movement past the dowels in either direction. The waterproof covering for the umbrella may be thermoplastic sheet heat sealed in place on the struts.

Prior art U.S. Pat. No. 6,237,615, issued May 29, 2001 to Corso et al., provides an umbrella having a molded handle, a translucent telescopic center shaft, and a plastic dome. When opened the umbrellas' dome is supported by a series of flexible plastic spokes with living hinges. The plastic dome is attached to the spokes by heat welding to supporting tabs. The section of the telescoping shaft nearest the handle has a cut out section for insertion of a "lightstick" so that the user can activate the chemically based glowstick and insert it into the cutout section and also remove and replace it as needed.

Prior art U.S. Pat. No. 5,533,535, issued Jul. 9, 1996 to Lin, puts forth a pocketable folding umbrella includes a slim upper notch generally rectangular shaped and secured on an upper portion of a central shaft; a slim lower runner generally rectangular shaped and slidably held on the central shaft; a plurality of extremity rib sets radially pivotally secured to two extremity portions of the upper notch and the lower runner, a plurality of flat-side rib sets universally pivotally secured to two flat-side portions of the upper notch and the lower runner, and an umbrella cloth secured with the rib sets, whereby upon folding of an opened umbrella, the flat-side rib sets will be inwardly folded towards a flat side portion of the upper notch and the lower runner as accompanied with a radially folding of the extremity rib sets on the two extremity portions of the upper notch and the lower runner for greatly minimizing the volume of the folded umbrella for a convenient carrying and storage.

Prior art U.S. Pat. No. 6,164,303, issued Dec. 26, 2000 to Lin, illustrates a slim rib assembly for umbrella includes: at least a top rib pivotally secured to an upper notch fixed on a top portion of a central shaft, a stretcher rib pivotally connected with the top rib and pivotally secured to a runner slidably held on the shaft an intermediate connecting rib pivotally connected to the top rib through an intermediate connecting rib, and a tail rib pivotally connected to the intermediate rib; with the top rib formed as a slim elongate rod having an outermost end of the top rib formed as a flat thinning end portion pivotally connected with a pair of narrowing lugs centripetally pressed from two side walls of the U-shaped groove of the stretcher rib; and having an outer portion of the top rib formed as a flat thinning portion for pivotally connecting an inner end of the intermediate connecting rib, thereby forming a slim rib assembly for minimizing a folding volume of the rib assembly when closing the umbrella adapted for making a slim mini pocketable folding umbrella.

What is needed is a thin plastic cover, fold-up umbrella with thin structural supports which fits within a pen case or a personal care product case which becomes the handle for the umbrella.

BRIEF SUMMARY OF THE INVENTION

An object of the present invention is to provide a thin plastic cover, fold-up umbrella with thin structural supports which fits within a pen case or a personal care product case or case for other products normally carried by a user, which case becomes the handle for the umbrella to insure that the umbrella will always be carried by the person to be prepared for rain or bright sun.

Another object of the present invention is to provide an umbrella in a small case for personal items, the umbrella having a telescoping support post which automatically telescopes out by a push button.

One more object of the present invention is to provide an umbrella housed in a personal product case with a very thin plastic or waterproof nylon cover which folds up compactly to fit within the small case.

An additional object of the present invention is to provide an umbrella housed in a personal product case with a cover which has a decorative color or pattern or indicia which may be related to a team, an event, or may be advertising indicia.

In brief, a pen or cosmetic or other personal care product case contains a multi-fold thin support frame and thin cover on a center telescoping support post which extends out automatically opening the umbrella with the push of a button. The case becomes the handle for the mini umbrella. The case may be up to three quarters of an inch in diameter and up to six inches long. The telescoping support post may extend out six to twelve inches and the umbrella cover may extend out to approximately two feet. The umbrella may be combined with a writing implement, a cosmetic, a cosmetic applicator, a cosmetic container, a grooming item, a grooming item applicator, a grooming item container, a hygiene item, a hygiene item applicator, or a hygiene item container.

An advantage of the present invention is that it provides a portable mini umbrella.

Another advantage of the present invention is that it saves space by combining an umbrella with a normally carried item.

An additional advantage of the present invention is that it the user will carry the umbrella at all times since it is combined with an object used on a daily basis.

One more advantage of the present invention is that may have advertising indicia thereon.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

In FIGS. 1-8, the invention comprises a combination umbrella and personal item storage case device 20.

Figure 2:
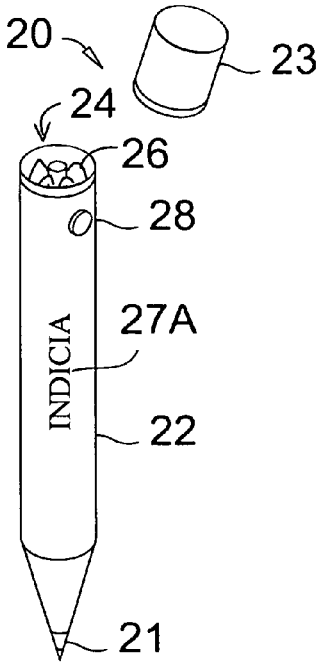
FIG. 2 is a perspective view of the outer case of FIG. 1, shown with the top cover removed and a folded up umbrella stored with the opening in the top end of the case.
Figure 6:
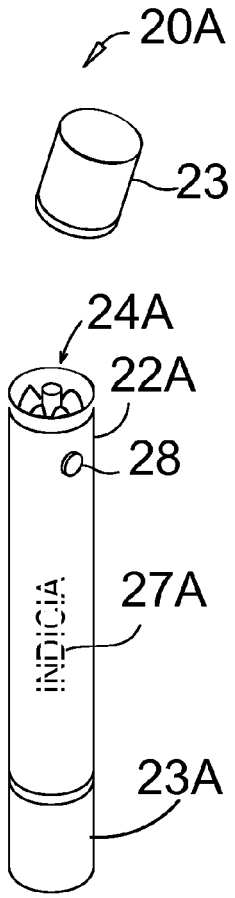
FIG. 6 is a perspective view of the outer case of FIG. 5, shown with the top cover removed and a folded up umbrella stored with the opening in the top end of the case.
Figure 7:
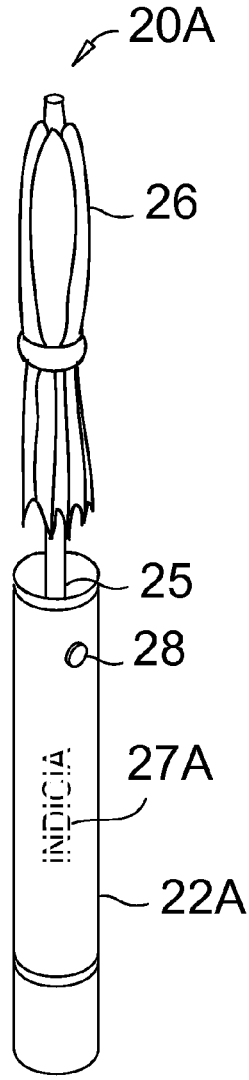
FIG. 7 is a perspective view of the outer case of FIG. 5, shown with the top cover removed and the umbrella extending from the opening in the top end of the case with the umbrella partially open showing the folded up cover of the umbrella.

The device 20 comprises a collapsible umbrella having a cover material 26 sufficiently broad in size to cover a head and shoulders of a user when the cover material 26 is expanded outwardly, the cover material 26 being sufficiently thin to fold up compactly into a confined space 15A. The umbrella 26 further comprises a telescoping pole 25 having two or more hollow sleeves which nest together in a collapsed storage configuration to a length not greater than six inches and which telescope out in an expanded support configuration to a length not less than 12 inches. The umbrella 26 also includes a plurality of collapsible structural supports 12 attached in a radial array around the telescoping pole 25 each attached to the telescoping pole 25 by a pivotable connection. Each of the structural supports 12 comprise multiple segments interconnected by pivot connections 11 to pivot outwardly to support the cover material 26. The segments each comprise an elongated finger no greater than six inches in length and sufficiently narrow so that all of the multiple segments folded in a collapsed storage configuration around the telescoping pole 25, as shown in FIGS. 2 and 6, so that the telescoping pole 25 encircled by the multiple segments 12 and the cover material 26 all in the collapsed storage configuration fit within a space less than an inch wide and no greater than six inches long in order to fit inside the case 22 along with the personal use item.

Figure 4:
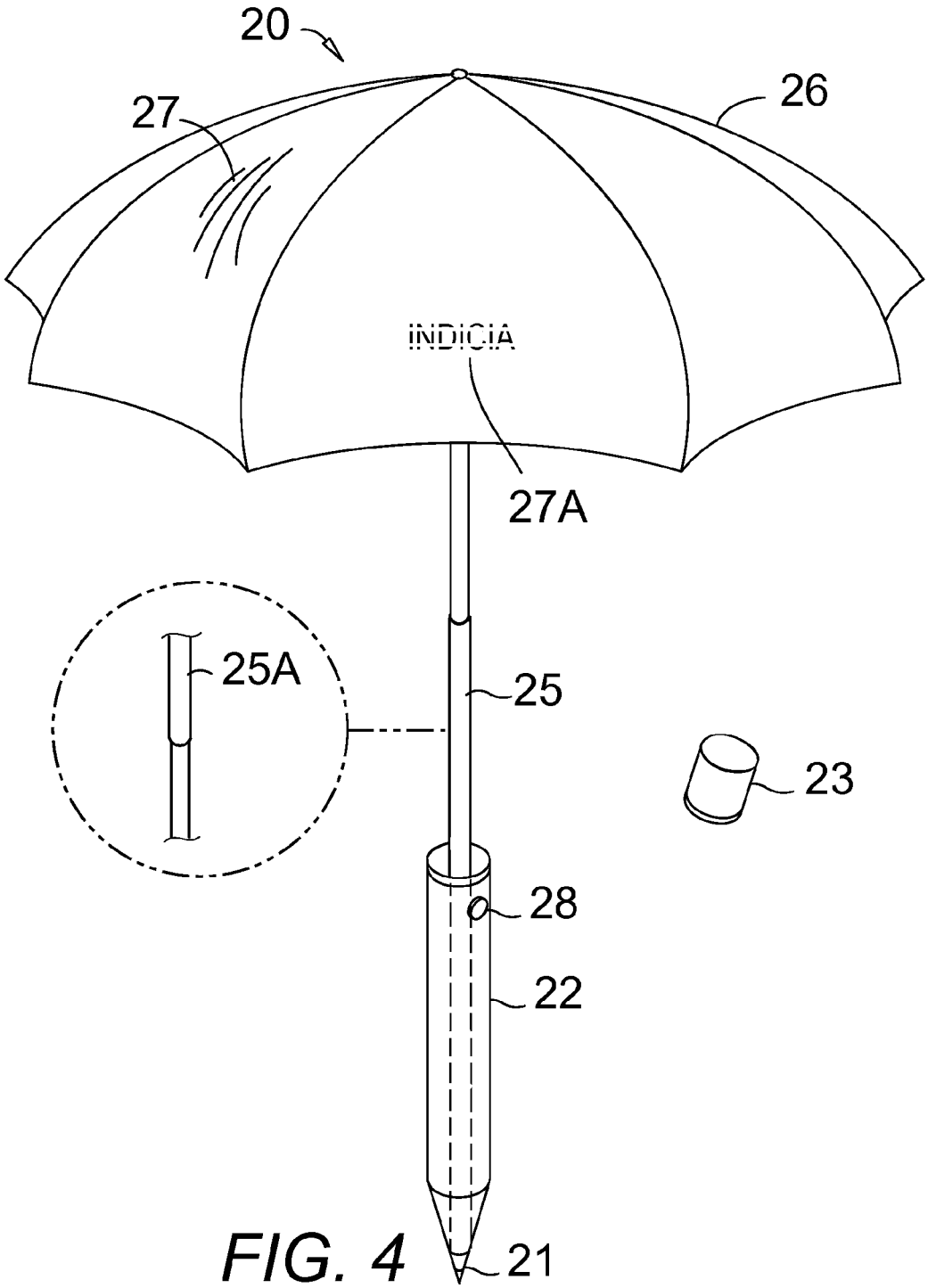
FIG. 4 is a perspective view of the outer case of FIG. 1, shown with the top cover removed and the umbrella extending from the opening in the top end of the case with the umbrella fully open showing the expanded cover of the umbrella.
Figure 8:
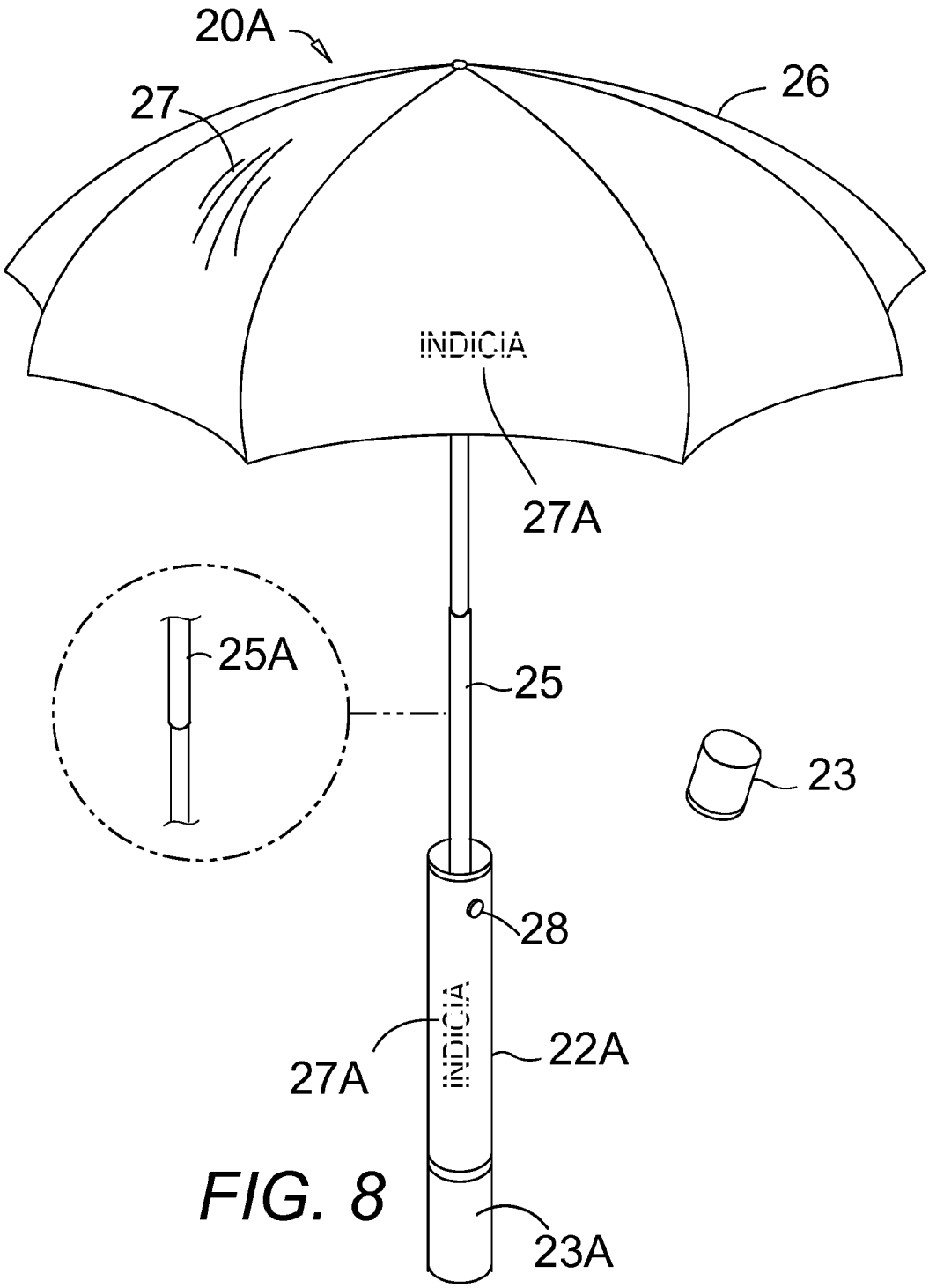
FIG. 8 is a perspective view of the outer case of FIG. 5, shown with the top cover removed and the umbrella extending from the opening in the top end of the case with the umbrella fully open showing the expanded cover of the umbrella.

The combined umbrella and personal storage device 20 further comprises a case 22 housing a personal use item 21 and 21A and housing the collapsible umbrella 26. The case 22 comprises an outer hand grip surface for holding the collapsible umbrella 26 upright in the expanded use configuration, as shown in FIGS. 4 and 8. The telescoping pole may taper from larger telescoping sections at the bottom to smaller telescoping sections at the top, as in the telescoping pole 25 shown on the device, or alternatively it may taper from larger telescoping sections at the top to narrower telescoping sections at the bottom, as shown in the circled alternative telescoping pole 25A. The case 22 also comprises a top opening 24 to admit passage of the collapsible umbrella 26 into and out of the case 22 and a bottom means, which may be bottom openings 18 and 18A, for accessing the personal use item 21 and 21A. The case 22 is configured in an elongated shape, preferably cylindrical, sized to fit within a pocket and alternately in a purse.

Figure 3:
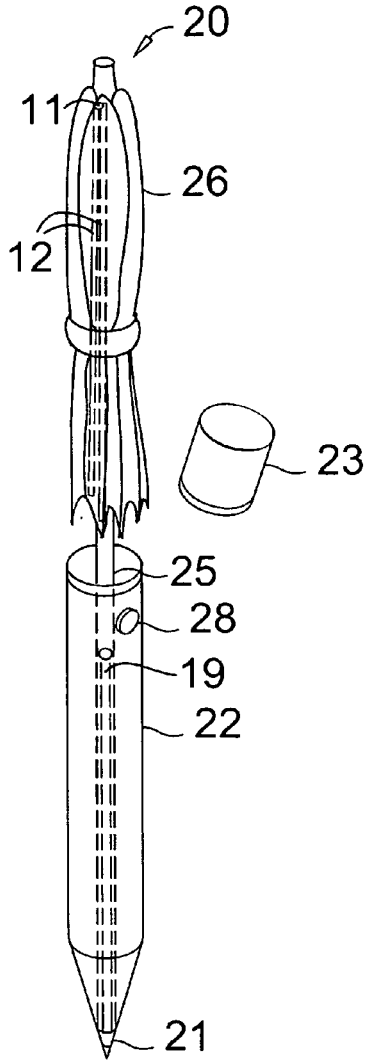
FIG. 3 is a perspective view of the outer case of FIG. 1, shown with the top cover removed and the umbrella extending from the opening in the top end of the case with the umbrella partially open showing the folded up cover of the umbrella and showing the pen refill fitting within a bottom sleeve of the telescoping pole.

In FIGS. 1-4 the case has a single elongated interior space with top opening 24 and bottom opening 18. The personal use item 21 and 21A is configured in a narrow elongated shape 19 and is housed within a sleeve of the telescoping pole 25, as shown in FIG. 3. The personal use item, such as a writing implement 21 or an eye make-up applicator 21A, comprises an item normally carried with the user taken from a list of personal use items including a writing implement 21, a cosmetic such as lipstick 21B, a cosmetic applicator 21A, a cosmetic container, a grooming item, a grooming item applicator, a grooming item container, a hygiene item, a hygiene item applicator, a hygiene item container or any other small item that would fit in the case and normally be carried by a user.

In FIGS. 5-8, the case 22 may have two elongated interior storage spaces 15A and 15B for receiving and retaining both the collapsible umbrella 26 in the collapsed storage configuration in the top storage space 15A accessed through the top opening 24 and the personal use item, such as a lipstick 21B in the bottom storage space 15B which may have a twist action cylinder 14 for causing the lipstick 21B to extend and retract through the bottom opening 18A.

The cover material 26 of the combined umbrella and personal storage device 20 and 20A may have a coating 27 thereon for blocking UV or other rays or may be a color or pattern or have reflective or neon glow coatings thereon or may be imprinted thereon with indicia 27A which may be related to a person's name, a team, an event, any of a variety of characters or animals or other images or may be advertising indicia, as shown in FIGS. 4 and 8.

In FIGS. 1-4, the combination device 20 preferably comprises a personal use item 21 which is a writing implement 21 and the means for accessing the personal use item 21 comprises a tapered tip 17 as a bottom extension of the case 22 having a tip opening 18 in a lower end of the tapered tip 17 to admit a writing tip 21 of the writing implement to protrude therethrough for use.

Figure 1A:
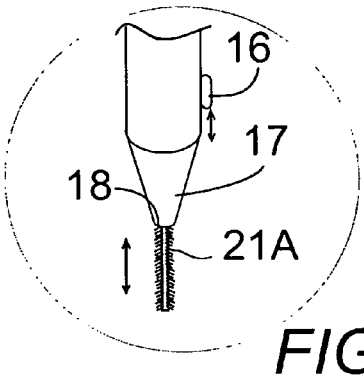
FIG. 1A is a partial perspective view of the outer case of the present invention, which has a cosmetic applicator brush point extending from a bottom end of the case.
Figure 1:
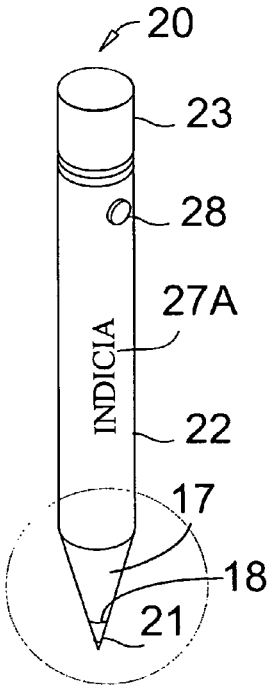
FIG. 1 is a perspective view of the outer case of the present invention, which has a ball point pen point extending from a bottom end of the case.

In FIG. 1A, the combination device 20 may comprise a personal use item 21A which is a cosmetic with a narrow elongated cosmetic applicator 21A and the means for accessing the personal use item 21A comprises a tapered tip 17 as a bottom extension of the case 22 having a tip opening 18 in a lower end of the tapered tip 17 to admit an applicator end of the cosmetic applicator 21A to protrude therethrough for use.

In an alternate embodiment shown in FIGS. 5-8, the combination device 20A may comprise a case 22A having two interior storage spaces 15A and 15B, an elongated top interior storage space 15A for receiving and retaining the collapsible umbrella 26 and a bottom interior storage space 15B for receiving and retaining a personal use item 21B therein, wherein the bottom means for accessing the personal use item 21B comprises a covered bottom opening 18A which is uncovered by removing the bottom cap 23A to access the personal use item 21B.

Figure 5:
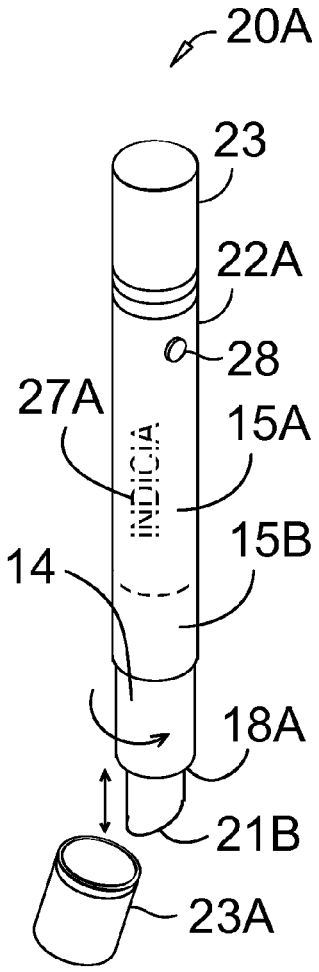
FIG. 5 is a perspective view of the outer case of the present invention, which houses a collapsible umbrella in a top chamber and a lipstick in a bottom chamber, the lipstick shown extending from the bottom opening, other cosmetic or personal care product in a bottom end of the case.

In FIG. 5, the combination device 20A may include a personal use item which is a cosmetic stick 21B, which may be lipstick, and the case 22A further comprises a twistable cylinder 14 means or other means for extending and contracting the cosmetic stick 21B through the bottom covered opening 18A for use, as indicated by the rotational arrow.

The bottom space 15B may house a personal use item comprising a self-contained item (such as a perfume vial, breath mints or spray, a pill bottle, hygiene products or any other small items normally carried by the user) which is placed in the bottom interior storage space 15B for storage and completely removed through the bottom covered opening 18A for use.

In use, the umbrella cap 23 is removed and the umbrella 26 is extended by pushing the umbrella release button 28; a center telescoping support post 25 extends out automatically opening the structural supports 12 of the umbrella cover 26. The case 22 becomes the handle for the mini umbrella 26. The case 22 may be preferably not greater than three quarters of an inch in diameter and up to six inches long. The telescoping support post 25 may extend out six to twelve inches and the umbrella cover 26 may extend out to approximately two feet.

The umbrella 26 may be combined with a pointing implement or laser pointing or implement writing implement 21, a cosmetic 21B, a cosmetic applicator 21A, a cosmetic container, a grooming item, a grooming item applicator, a grooming item container, a hygiene item, a hygiene item applicator, a hygiene item container, or any other personal use item normally carried by the user. The umbrella cover 26 may be housed in a personal product case 22 with a cover which has a coating 27 thereon for blocking UV or other rays or may be a color or pattern or have reflective or neon glow coatings thereon or may be imprinted thereon with indicia 27A which may be related to a person's name, a team, an event, any of a variety of characters or animals or other images or may be advertising indicia for a variety of uses and applications.

In FIG. 1A, the brush applicator tip 21A of the combination device 20 is extended through the bottom opening 18 by manually sliding a switch 16.

In FIG. 5, the lipstick 21B of the combined device 20A may be extended through the bottom opening 18A, after removing the bottom cap 23A, by turning the cylinder 14, as indicated by the rotational arrow.

It is understood that the preceding description is given merely by way of illustration and not in limitation of the invention and that various modifications may be made thereto without departing from the spirit of the invention as claimed.

What is claimed is:

1. A miniature umbrella and personal storage case combination device comprising (a) a hollow, elongated, cylindrical housing having an open top end and a bottom end tapering to a point forming a centrally disposed opening, the bottom end defining personal item retaining space inseparable from the housing and formed to retain store and permit a personal item to protrude through the opening, (b) a collapsible, foldable miniature umbrella having a foldable canopy and a plurality of telescoping, hollow, support poles attached at one end to the canopy, the umbrella being sized and formed to fit within the housing in its folded and collapsed position with the other end of the support poles attached at the bottom of the housing such that in use the support poles extend through the open top end of the housing and the canopy expands to an outwardly expanded position without the need to reorient the umbrella so that the umbrella covers the device user's head and shoulders when held in an upright and overhead position, and (c) spring-loaded push button means formed and located in the housing for automatically extending and expanding the umbrella from its position within the housing to its extended and expanded position outside the housing.

2. The device of claim 1 wherein the personal item retaining space comprises one of the hollow poles of the umbrella.

3. The device according to claim 1, the device additionally comprising a removable cap formed and positioned to close the top end of the housing.

4. A miniature umbrella and personal storage case combination device comprising (a) a hollow, elongated, cylindrical housing having an open top end and a bottom end tapering to a point forming a centrally disposed opening, the bottom end defining personal item retaining space inseparable from the housing and formed to retain store and permit a personal item to protrude through the opening, (b) a collapsible, foldable miniature umbrella having a foldable canopy and a plurality of telescoping, hollow, support poles attached at one end to the canopy, the umbrella being sized and formed to fit within the housing in its folded and collapsed position with the other end of the support poles attached at the bottom of the housing such that in use the support poles extend through the open top end of the housing and the canopy expands to an outwardly expanded position without the need to reorient the umbrella so that the umbrella covers the device user's head and shoulders when held in an upright and overhead position, (c) spring-loaded push button means formed and located in the housing for automatically extending and expanding the umbrella from its position within the housing to its extended and expanded position outside the housing, and (d) a removable cap formed and positioned to close the open top end of the housing.

* * * * *